United States Patent [19]

Klein et al.

[11] 4,175,244

[45] Nov. 20, 1979

[54] LAMP FILAMENT CONFIGURATION FOR USE IN A DRUM LENS

[75] Inventors: William R. Klein; William V. Burns, both of Houston, Tex.

[73] Assignee: Tideland Signal Corporation, Houston, Tex.

[21] Appl. No.: 940,939

[22] Filed: Sep. 11, 1978

[51] Int. Cl.[2] ..... K01K 1/14

[52] U.S. Cl. ..... 313/315; 362/215; 313/316

[58] Field of Search ..... 313/316, 273, 315; 362/215, 211

[56] References Cited

U.S. PATENT DOCUMENTS

| | | | |
|---|---|---|---|
| 905,703 | 12/1908 | Jaeger | 313/273 |
| 996,268 | 6/1911 | MacDonald | 313/316 X |
| 1,508,302 | 9/1924 | Schnur | 313/273 X |

*Primary Examiner*—Paul L. Gensler
*Assistant Examiner*—Charles F. Roberts
*Attorney, Agent, or Firm*—Fulbright & Jaworski

[57] ABSTRACT

The improvement in a filament system in a lamp for use in a drum lens of a navigational light in which a plurality of vertically positioned similar filaments are spaced about but away from a vertical axis adapted to be placed at the focal point of the lens. The filaments are positioned in a horizontal plane relative to each other whereby no more than two filaments are aligned in any horizontal direction. In using four filaments, three of the filaments are positioned at the corners of a horizontal square and the fourth filament is positioned outside of tne unoccupied corner of the square and in line with the diagonal of the square through the unoccupied corner thereby minimizing shadowing of one filament by other filaments in any horizontal direction. The vertical height of the filaments are short, such as approximately ten millimeters thereby confining the beam spread from the lens and the filaments are positioned close to the center of the square for minimizing defocusing of the light passing through the lens.

6 Claims, 5 Drawing Figures

LAMP FILAMENT CONFIGURATION FOR USE IN A DRUM LENS

BACKGROUND OF THE INVENTION

Navigational lights utilizing drum lenses are being required to have increasingly greater light outputs. However, there is a maximum practical optical output which can be radiated from a unit of filament surface. In addition, vertical beam spread of light from an ideal drum lens is in direct proportion to the length or height of the lamp filament and high intensity lamp filaments often exceed the minimum length resulting in beam divergencies in an excess of the minimum value required. These problems can be overcome to some extent by utilizing multiple short filaments for increasing the optical output and narrowing the beam of light from the lens.

However, multiple filaments introduced problems of their own. One of the problems of multiple filaments is caused by shadowing. That is, it is desired to maintain an optical output from the lens in a wide horizontal direction, and therefore some of the filaments will be aligned with other filaments causing shadowing or reducing of the light output in the direction of aligned filaments. Furthermore, with a multiplicity of filaments, the filaments will not be positioned on the focal point of the drum lens thereby causing defocusing of the light and consequent undesirable beam spreading.

The present invention is directed to an improved lamp filament configuration for use in drum lenses of a navigational light in which the filaments are positioned to reduce filament shadowing and defocusing, and provide increased light output with a minimum of power.

SUMMARY

The present invention is directed to a filament system in a lamp for use in a drum lens of a navigational light in which at least four vertically positioned similar filaments are spaced about but away from a vertical axis adapted to be placed at the focal point of the lens. The filaments are positioned in a horizontal plane relative to each other whereby no more than two filaments are aligned in any horizontal direction thereby reducing filament shadowing.

Still a further object of the present invention is the provision of a lamp filament configuration having at least four filaments in which the vertical height of the filaments is limited, such as approximately ten millimeters, thereby limiting beam spread from the lens.

Still a further object of the present invention is the provision of a multiple filament system for a lamp having four vertically positioned similar filaments in which three of the filaments are positioned at the corners of a horizontal square in which the center of the square is adapted to be placed at the focal point of a drum lens. The fourth filament is positioned outside of the unoccupied corner of the square in line with the diagonal of the square through the unoccupied corner thereby minimizing shadows of one filament by other filaments in any horizontal direction.

Yet a further object of the present invention is the sizing of the sides of the square at a minimum, such as approximately ten millimeters, thereby positioning the filaments as close as practical to the center of the square for minimizing defocusing and wherein the fourth filament is positioned approximately three millimeters from the unoccupied corner thereby reducing horizontal shadowing between the filaments without undue defocusing.

Other and further objects, features and advantages will be apparent from the following description of a presently preferred embodiment of the invention, given for the purpose of disclosure and taken in conjunction with the accompanying drawing.

DESCRIPTION OF THE PREFERRED EMBODIMENT

Figure 1:
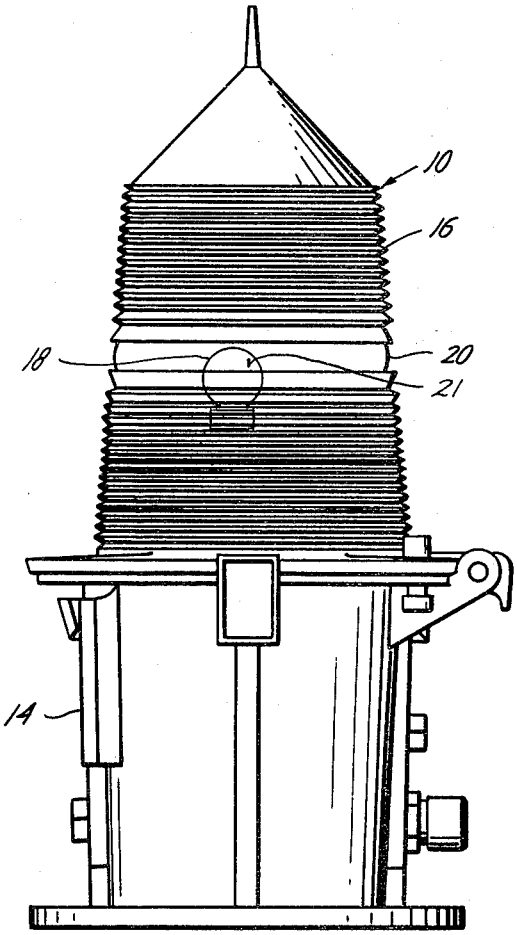
FIG. 1 is an elevational view of a conventional navigational light having a drum lens in which a lamp utilizing the filament configuration of the present invention is used.

Referring now to the drawings, and particularly to FIG. 1, the reference numeral 10 generally indicates any navigational light, which may be Model ML-300 of Tideland Signal Corporation, having a base 14 and a drum lens 16 in which a lamp 18 utilizing the present invention is placed at the focal plane 20 of the lens 16.

Figure 2:
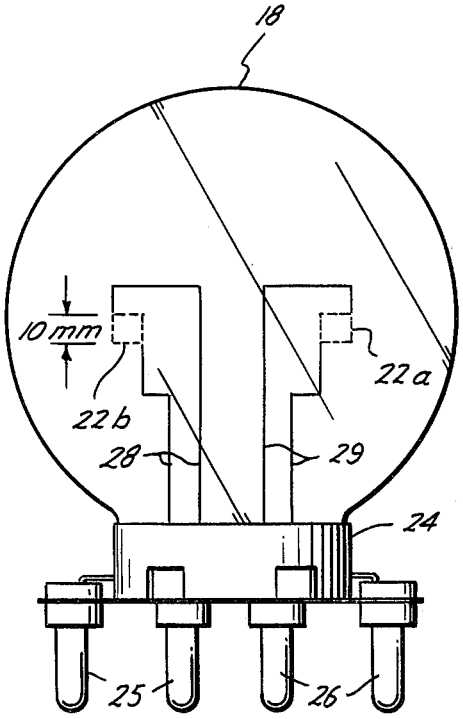
FIG. 2 is an enlarged elevational view of one embodiment of a lamp of the present invention utilizing dual filament systems of the present invention.

Referring now to FIG. 2, the lamp 18, preferably includes dual filament systems **22*a* and 22*b* embodying the present invention and is mounted on a base 24. One of the filament systems, either 22*a* or 22*b*, is positioned at the focus 21 of the drum lens 16 and when the filament in the operating position, such as 22*a* burns out, the lamp 18 is conventionally rotated to move the other filament system 22*b* into the operating position at the focal center 21 of the lens 16. The lamp 18 includes electrical contacts 25 and 26 for conducting electricity through electrical conductors 28 and 29 to the filament systems 22*a* and 22*b***, respectively.

The present invention is directed to providing a multiple filament system which provides the desired optical intensity, reduces filament shadowing, reduces beam spread, and reduces defocusing. Preferably, referring now to FIGS. 3 and 4, the filament system **22*a* includes four vertically positioned similar filaments 30*a*, 32*a*, 34*a*, and 36*a*. Similarly, the filament system 22*b* consists of filaments 30*b*, 32*b*, 34*b*, and 36*b*. Preferably, the vertical height of each of the filaments is approximately ten millimeters, as contrasted to standard high intensity lamp filaments in use of thirty millimeters, thereby confining the light beam spread through the lens 16 to a minimum. That is, the vertical beam spread of light from a drum lens 16 is in direct proportion to the length of the lamp filament. Since the maximum practical optical output which can be radiated from a unit of filament surface is limited, the use of multiple filaments of minimum lengths allow the provision of the necessary power output, but confines the power output to a narrow beam as required thereby avoiding wasting power. However, the principal problem of using multiple filaments is that the drum lens 16** is required to direct light over a wide range of a horizontal direction, generally at least 270° and therefore the light output in some horizontal directions will be blanketed or shadowed as two or more filaments are aligned in some horizontal directions.

The preferred embodiment of the present invention utilizes four filaments, which is sufficient to provide the necessary power output, and which are positioned in a horizontal plane such that no more than one filament is shadowed as observed in any horizontal direction. Preferably, three of the filaments are arranged at three of the corners of a square such as filaments 30*a*, 32*a*, and 34*a* of system 22*a* and 30*b*, 32*b*, and 34*b* of system 22*b*. When in use, the filament system 22*a* and 22*b* are alternately positioned with the centers of the square 38*a* and 38*b* at the focus 21 of the drum lens 16. The dimensions of the squares are the minimum permitted by practical consideration in order to position the filaments as close to the centers 38*a* and 38*b* of the squares and thus on the focus 21 in order to reduce defocusing and consequent beam spreading by the lens 16. The fourth filament, filament 36*a* in system 22*a* and filament 36*b* in system 22*b*, is placed outside of the unoccupied corner of the square along a diagonal of the square passing through the unoccupied corner and moved outwardly far enough to avoid shadowing when viewed along a direction parallel to the sides of the square. For example, the filaments 36*a* and 36*b* are offset from each side of the square adjacent the unoccupied corner approximately two millimeters or approximately three millimeters from the unoccupied corner thereby reducing horizontal shadowing between filaments without causing undue defocusing.

While the outside filaments 36*a* and 36*b* could be placed within the squares from a configuration standpoint, this would require that the size of the square be increased thereby increasing the distance of the other filaments from the center of the square and increasing defocusing.

Figure 3:
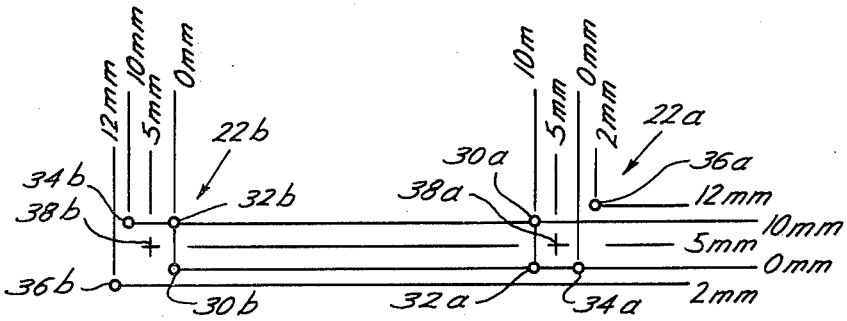
FIG. 3 is an enlarged top elevational view of the filament configuration of the dual filament systems of the lamp of FIG. 2.
Figure 4:
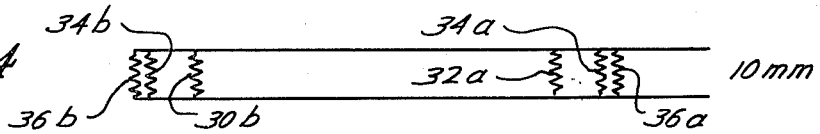
FIG. 4 is a side elevational view of the dual lamp configurations in the lamp of FIG. 2.
Figure 5:
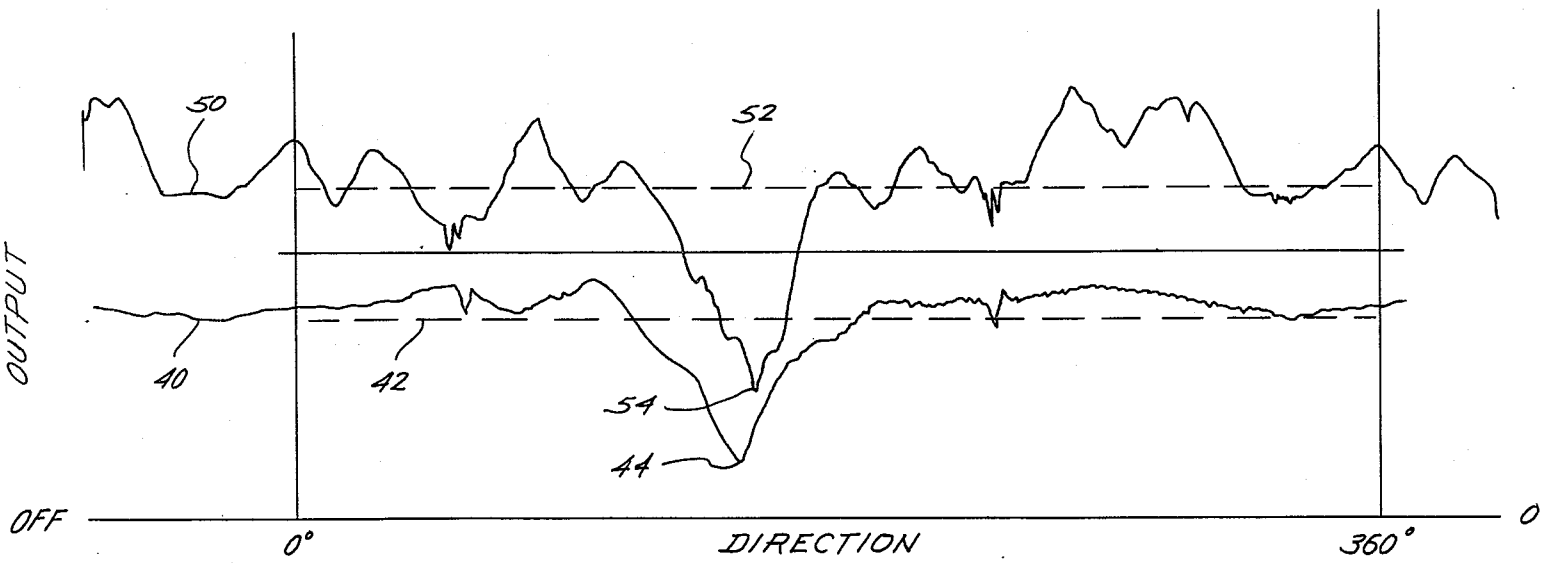
FIG. 5 is a graph showing the light output of the present invention as compared with a conventional filament.

Referring now to FIG. 5, a graph 40 is shown showing the light output from a conventional 1000 watt single thirty millimeter high filament which was operated at a 120 volts and 8.33 amps to provide a power input of 1000 watts. Graph 50 is a graph of the output of one of the filament systems 22*a* or 22*b* positioned as shown in FIGS. 3 and 4 at 130 volts and 5.8 amps to provide a power input of 754 watts. Both of the lamps tested on the graphs of FIG. 5 were focused in a Tideland ML-300 HI drum lens and an azimuth scan of 360° was taken. The average light output 42 from the graph 40 was 14,625 cd while the average output 52 from the graph 50 of the present invention was 23,975 cd. Each of the output graphs 40 and 50 had a low point, such as 44 and 54, respectively. The low point 44 in the conventional lamp was due to a large post opposite the single filament which shadowed the filament in one direction. In the case of the graph 50, the lamp tested had dual filament systems 22*a* and 22*b* whereby one of the systems would shadow the other at the low output 54. Of course, a single filament system may be used, but often navigational lights only require a horizontal output of approximately 270° and dual systems are desirable for safety. It is to be particularly noted that the present invention provided an increased light output as compared to a standard lamp in addition to using only 754 watts as compared to 1000 watts for the conventional lamp.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. In a lamp for use in a drum lens of a navigational light, the improvement in a filament system in the lamp comprising, at least four vertically positioned similar filaments spaced about but away from a vertical axis adapted to be placed at the focal point of the lens, said filaments positioned in a horizontal plane relative to each other whereby no more than two filaments are aligned in any horizontal direction.

2. The apparatus of claim 1 wherein the vertical height of the filaments is approximately ten mm thereby confining beam spread from a lens.

3. In a lamp for use in a drum lens of a navigational light, the improvement in a multiple filament system in the lamp comprising, four vertically positioned similar filaments positioned in said lamp, three of said filaments positioned at the corners of a horizontal square, the center of the square adapted to be placed at the focal point of the lens, and the fourth filament being positioned outside of the unoccupied corner of the square in line with the diagonal of the square through the unoccupied corner thereby minimizing shadowing of one filament by other filaments in any horizontal direction.

4. The apparatus of claim 3 wherein the vertical height of the filaments is approximately ten mm thereby confining beam spread from a lens.

5. The apparatus of claim 4 wherein the sides of the square are approximately ten mm thereby positioning the filaments close to the center of the square for minimizing defocusing.

6. The apparatus of claim 5 wherein the fourth filament is positioned approximately three mm from the unoccupied corner thereby reducing horizontal shadowing between filaments without undue defocusing.

* * * * *